US007863530B2

(12) United States Patent
Mattlar et al.

(10) Patent No.: US 7,863,530 B2
(45) Date of Patent: Jan. 4, 2011

(54) MODULAR SWITCHING DEVICE

(75) Inventors: Harri Mattlar, Iskmo (FI); Rainer Kolmonen, Laihia (FI); Juho Salo, Vaasa (FI); Osmo Pikkala, Sundom (FI); Aki Suutarinen, Vaasa (FI); Jarkko Alanen, Ylihärmä (FI); Martti Tuononen, Vaasa (FI)

(73) Assignee: ABB Oy, Helsinki (FI)

( * ) Notice: Subject to any disclaimer, the term of this patent is extended or adjusted under 35 U.S.C. 154(b) by 1141 days.

(21) Appl. No.: 10/586,522

(22) PCT Filed: Jan. 18, 2005

(86) PCT No.: PCT/FI2005/000032

§ 371 (c)(1),
(2), (4) Date: Jul. 19, 2006

(87) PCT Pub. No.: WO2005/069324

PCT Pub. Date: Jul. 28, 2005

(65) Prior Publication Data

US 2007/0063796 A1 Mar. 22, 2007

(30) Foreign Application Priority Data

Jan. 19, 2004 (FI) ..... 20040065

(51) Int. Cl.
*H01H 9/26* (2006.01)

(52) U.S. Cl. ..... 200/50.32

(58) Field of Classification Search ... 200/50.32–50.39, 200/400, 401, 500, 501, 293, 303, 307, 330, 200/331

See application file for complete search history.

(56) References Cited

U.S. PATENT DOCUMENTS

| | | | | |
|---|---|---|---|---|
| 3,786,380 | A * | 1/1974 | Harper | 335/9 |
| 3,840,833 | A * | 10/1974 | Mrenna et al. | 337/43 |
| 4,112,270 | A * | 9/1978 | Rys | 200/50.32 |
| 4,727,226 | A * | 2/1988 | Comtois et al. | 200/50.32 |
| 5,001,315 | A * | 3/1991 | Runyan et al. | 200/307 |
| 5,557,082 | A * | 9/1996 | Leet et al. | 200/50.35 |
| 5,652,420 | A * | 7/1997 | Innes et al. | 200/50.32 |
| 5,686,709 | A * | 11/1997 | Casagrande et al. | 200/50.32 |
| 5,777,283 | A | 7/1998 | Greer | |
| 6,259,338 | B1 | 7/2001 | Boeder et al. | |
| 6,747,535 | B2 * | 6/2004 | Castonguay et al. | 335/132 |
| 6,919,518 | B2 * | 7/2005 | Rademacher et al. | 200/1 R |
| 7,342,474 | B2 * | 3/2008 | Castonguay et al. | 335/172 |
| 7,566,841 | B2 * | 7/2009 | McCoy | 200/331 |

FOREIGN PATENT DOCUMENTS

| | | |
|---|---|---|
| WO | WO 03/009324 A1 | 1/2003 |
| WO | WO 03/050830 A1 | 6/2003 |

* cited by examiner

*Primary Examiner*—Michael A Friedhofer
(74) *Attorney, Agent, or Firm*—Buchanan Ingersoll & Rooney PC

(57) ABSTRACT

A modular switching device is disclosed which includes a plurality of interconnected modules, the modules having a control device module and a pole cell module, the modules of the switching device being interconnected with a shaft adapted to transfer a torque required for operating the switching device from one module to another module. The modular switching device is configured such that each module has a shaft element, and the shaft transferring the torque is composed of directly interconnected shaft elements.

9 Claims, 2 Drawing Sheets

MODULAR SWITCHING DEVICE

The present application claims priority under 35 USC §119 to Finnish Patent Application Number 20040065, filed Jan. 19, 2004, the disclosure of which is hereby incorporated by reference in its entirety.

BACKGROUND OF THE INVENTION

The invention relates to modular switching devices employed in electrical engineering.

Switching devices are instruments employed for opening and closing an electric circuit. The switching device comprises at least one pole and a control device adapted to open and close said pole. Switching devices include switches and switch-fuses, for example.

It is known to construct a switching device modular such that the switching device comprises a controller device module and pole cell modules. It is known to connect the control device module and the pole cell modules together with a main shaft such that the main shaft transfers the power required for opening and closing the poles of the switching device from the control device module to the pole cell modules.

The axial lengths of different switching device assemblies, i.e. the lengths in the direction of the main shaft, vary depending on the number of modules and the size of the individual modules. The thicknesses of the main shafts also vary in different assemblies. This is because the power required for opening and closing the poles is different in different switching device assemblies.

The problem in the above-described arrangement is that several types of main shafts have to be manufactured and stored for the different switching device assemblies.

BRIEF DESCRIPTION OF THE INVENTION

The object of the invention is to provide a switching device allowing the above-mentioned problems to be solved. The object of the invention is achieved with a switching device, which is characterized in what is stated in the independent claims. Preferred embodiments of the invention are described in the dependent claims.

The invention is based on each module of the switching device comprising a shaft element that is coupled directly to a shaft element of an adjacent module without a separate connecting element.

An advantage of the switching device of the invention is the facility of constructing and expanding different switching device assemblies.

BRIEF DESCRIPTION OF THE FIGURES

In the following, the invention will be described in more detail in connection with preferred embodiments with reference to the accompanying drawings, in which.

DETAILED DESCRIPTION OF THE INVENTION

Figure 1:
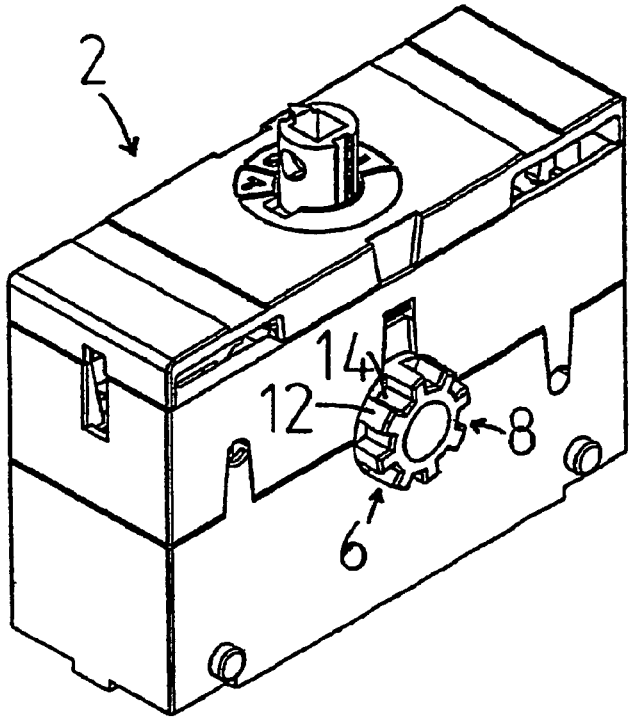
FIG. 1 shows the control device module of a switching device according to an embodiment of the invention seen obliquely from above.

A switching device according to an embodiment of the invention comprises a control device module 2 and several pole cell modules according to FIG. 1. The control device module 2 and the pole cell modules are interconnected with a main shaft, which is adapted to transfer the power required for opening and closing the poles of the switching device from the control device module 2 to each pole cell module.

The control device module 2 and each pole cell module of the switching device comprise a main shaft element 6. Each main shaft element 6 is adapted to be connected to the main shaft element 6 of an adjacent module. Consequently, the main shaft is composed of interconnected main shaft element 6, each of which is comprised by the corresponding module of the switching device.

Figure 2:
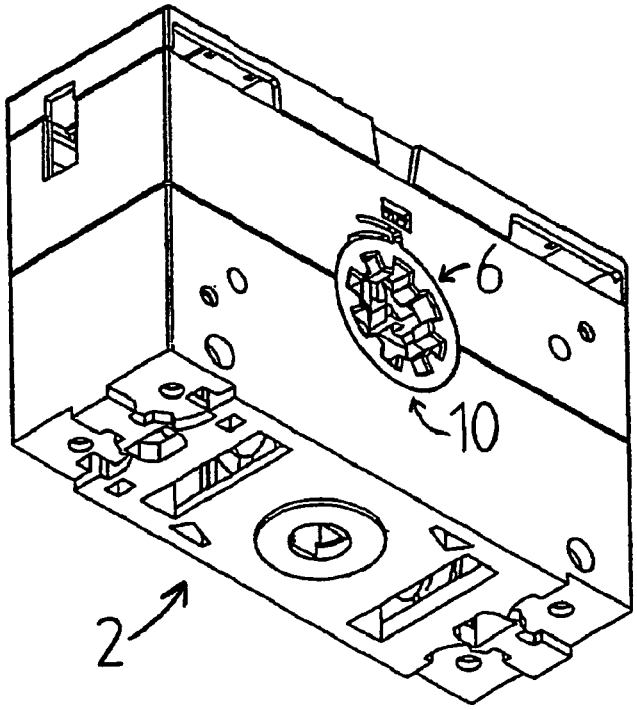
FIG. 2 shows the control device module of FIG. 1 seen obliquely from below.

FIGS. 1 and 2 show that a first end of the main shaft element 6 of the control device module 2 is provided with a male connecting member 8, and a second end is provided with a female connecting member 10. The type of the male connecting member 8 is a grooved shaft, a so-called spline shaft, and it comprises eight teeth 12 projecting in the radial direction, eight recesses 14 remaining between these teeth. The female connecting member 10 is an inner grooved shaft and it is adapted to receive the male connecting member 8 inside thereof.

Each module of a switching device according to an embodiment of the invention comprises a connecting member arrangement similar to that of the control device module 2 of FIG. 1, i.e. a first end of the shaft element is provided with a male connecting member 8, a second end being provided with a female connecting member 10.

Figure 3:
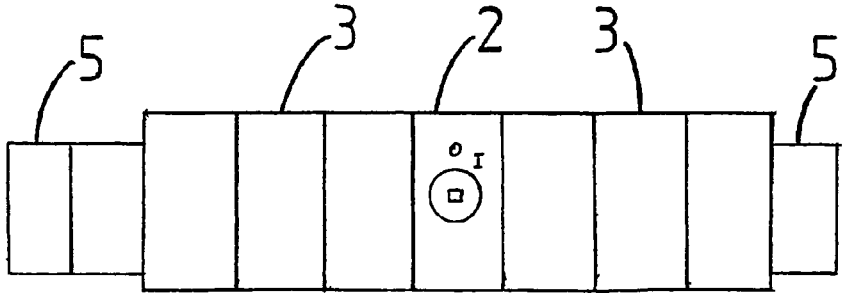
FIG. 3 shows a switching device assembly according to an embodiment of the invention.

The control device module 2 of FIG. 1 can be connected to an adjacent module, such as a pole cell module by means of either its male connecting member 8 or its female connecting member 10. It is also possible to achieve a switching device assembly wherein two other modules are connected to the control device module 2, the first of said modules being connected to the male connecting member 8 and the second of said modules being connected to the female connecting member 10. An example of such a switching device assembly is shown in FIG. 3.

The main shaft elements 6 and the other shaft elements, adapted to be connected to the main shaft elements, are preferably designed such that they are able to connect directly to each other and to transfer the required torque without separate connecting elements.

A switching device product series may comprise several switching devices having different frame sizes. Herein, frame size refers primarily to the physical dimensions of the switching device, although a given correlation exists between the physical dimensions and the nominal current values of the switching device. In other words, switching devices having high nominal currents are typically larger than switching devices having low nominal currents.

The powers required for opening and closing the poles of switching devices of different sizes may deviate considerably from each other. For this reason it is often justifiable to employ main shafts of different strengths in switching devices having different frame sizes.

A switching device may comprise not only a control device module and pole cell modules, but also one or more additional modules. Such an additional module may be an auxiliary contact module, for example. An auxiliary contact module comprises auxiliary contacts for locking, alarm, position indication and auxiliary circuits, for example.

FIG. 3 shows a switching device assembly according to an embodiment of the invention comprising a control device module 2, six pole cell modules 3, and three additional modules 5. The modules connected to the control device module 2 are positioned such that part of the modules are located in a first axial direction relative to the control device module 2, the rest being located in a second axial direction relative to the control device module 2. Herein, axial direction refers to the direction of the main shaft of the switching device, i.e. a horizontal direction in the case of FIG. 3.

In the assembly of FIG. 3, the pole cell modules 3 are connected to the control device module 2 such that three pole cell modules 3 are located on the left side of the control device module 2, the remaining three pole cell modules 3 being located on the right side of the control device module 2. The additional modules 5 are positioned such that two additional modules are connected to the left end of the switching device assembly, and the third additional module is connected to the right end of the switching device assembly. The driving shaft element of the additional module located at the right end of the assembly as well as the driving shaft element of the additional module located second from the left are connected to the main shaft element of the adjacent pole cell module 3, and the driving shaft element of the additional module 5 located at the left edge of the assembly is connected to the driving shaft element of the adjacent additional module.

The additional modules 5 usually comprise components whose operation requires a substantially smaller torque than is required for operating the contacts of the pole cell modules 3. In addition, the frame size of the control device module 2 and the pole cell modules 3 of the switching device assembly has practically no effect on the operating torque required by the additional modules 5 of the assembly, i.e. the same components are usually employed in the additional modules 5 irrespective of the frame size of the control device module 2 and the pole cell modules 3.

The driving shaft elements of the additional modules 5 of a particular switching device product series can be dimensioned for a higher or lower torque than or a torque equal to the main shaft element 6 of the pole cell module 3 of the smallest frame size in the product series, according to the need. In a preferred embodiment, the driving shaft elements of all additional modules in the same product series are dimensioned for an equally high torque.

A switching device product series according to an embodiment of the invention comprises pole cell modules and control device modules having different frame sizes, but only one type of additional modules. Such a product series may be composed for instance of four pole cell modules having different frame sizes, four control device modules having different frame sizes, and a plurality of different types of additional modules, which all have the same frame size, and which are adapted to be directly connected to any module of the same product series without adjusting parts.

The product series according to a second embodiment comprises pole cell modules and control device modules having different frame sizes, and different additional modules, which have different frame sizes but are adapted to be directly connected to any module of the same product series without adjusting parts.

An additional module 5 whose driving shaft element is dimensioned for substantially the same torque as the main shaft elements of the control device module 2 and the pole cell modules 3 of the switching device assembly, can in principle be connected to any axial point of the assembly. Consequently, it is possible to place such an additional module 5 between the control device module 2 and a pole cell module 3, or between two pole cell modules. By contrast, an additional module 5 whose driving shaft element is dimensioned for a substantially lower torque than are the main shaft elements 6 of the control device module 2 and the pole cell modules 3 of the switching device assembly has naturally to be positioned such that operating torque is not transferred through it from the control device module 2 to any pole cell module 3.

Figure 4A:
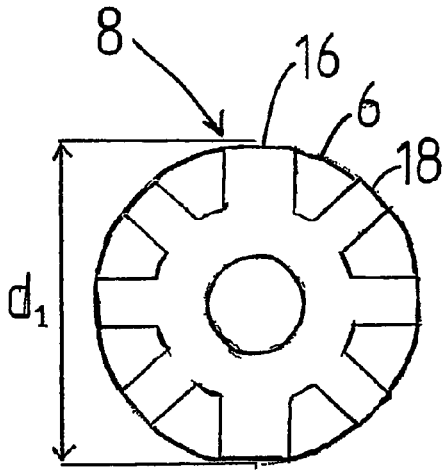
FIGS. 4*a* and 4*b* show cross-sections of the main shafts of some switching devices of the invention.
Figure 4B:
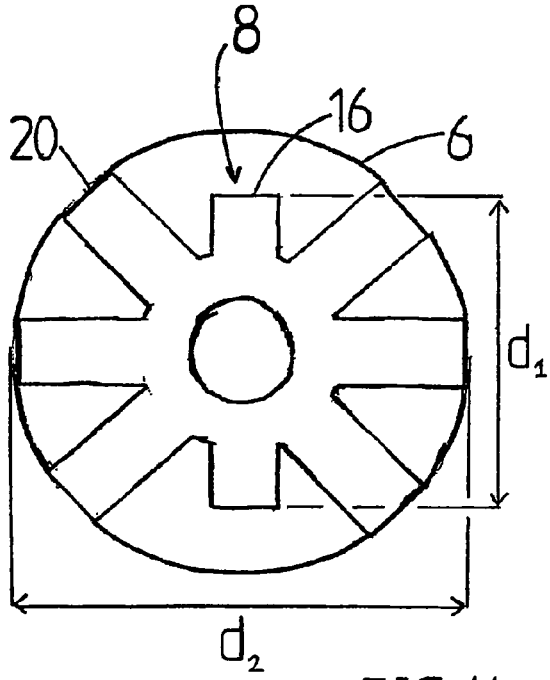

FIG. 4*a* shows a male connecting member 8 of the main shaft element 6 of a module having a first frame size in a switching device product series, seen from the axial direction, and FIG. 4*b* shows a male connecting member 8 of the main shaft element 6 of a module having a second frame size in the same product series. The main shaft element 6 of FIG. 4*a* belongs to a module whose frame size is smaller than the frame size of the module to which the main shaft element 6 of FIG. 4*b* belongs. This is why the diameter $d_1$ of the main shaft element 6 of FIG. 4*a* is smaller than the diameter $d_2$ of the main shaft element 6 of FIG. 4*b*.

The product series to whose modules the main shaft elements 6 of FIGS. 4*a* and 4*b* belong is adapted such that a similar additional module 5 can be connected to a control device module 2 or pole cell module 3 having any frame size. This feature is achieved with universal teeth 16. The male connecting members 8 of the main shaft elements 6 of all control device modules 2 and all pole cell modules 3 of the product series comprise a pair of universal teeth 16, which is substantially similar irrespective of the frame size. The female connecting members of the driving shaft elements of the additional modules 5 of the product series are adapted to connect to these universal teeth 16. Correspondingly, the female connecting members 10 of the main shaft elements 6 of all control device modules 2 and pole cell modules 3 of the product series comprise a pair of grooves, which is substantially similar irrespective of the frame size, and which is adapted to receive a pair of universal teeth 16. The male connecting members of the driving shaft elements of the additional modules 5 of the product series are adapted to connect to said pair of grooves adapted to receive the universal teeth.

The connecting member 8 of both FIG. 4*a* and FIG. 4*b* comprises eight teeth projecting in the radial direction and eight recesses remaining between these teeth. In both connecting members 8, the universal teeth 16 are placed at 180° from each other, i.e. they are located on opposite sides of the shaft.

In the connecting member 8 of FIG. 4*a*, teeth 18, which are not universal teeth 16, are equally long as but narrower than the universal teeth. Both the distance between the tips of the opposite universal teeth 16 and the distance between the tips of the other opposite teeth 18 are substantially the same as the diameter $d_1$ of the main shaft element 6. In the connecting member 8 of FIG. 4*b*, teeth 20, which are not universal teeth 16, are as broad as but longer than the universal teeth. The distance between the tips of the teeth 20, which are not universal teeth, is substantially the same as the diameter $d_2$ of the main shaft element 6.

The module of the switching device of the invention may comprise one or more universal teeth 16. The shape of the universal teeth 16 is not limited to the shapes shown in FIGS. 4*a* and 4*b*. If desired, the universal teeth 16 may be designed different from the other teeth of the main shaft element 6. Accordingly, the universal teeth 16 may be designed to have a substantially triangular cross-section, for example, even if the other teeth had a substantially rectangular cross-section, as in FIGS. 4*a* and 4*b*.

The one or more universal teeth 16 provided in the main shaft element 6 may be employed to facilitate the fitting of the modules of the switching device to each other, since said one or more universal teeth can be used to delimit the positions allowing the male connecting member 8 of a first module to be inserted into the female connecting member 10 of a second module. This allows for instance the correct position of the main shaft element 6 of the control device module 2 relative to the main shaft elements 6 of the pole cell modules 3 to be ascertained, whereby the zero position of the control device 2 corresponds to the open-position of the contacts of the pole cell modules 3, etc.

Both the main shaft elements 6 and the driving shaft elements are preferably designed such that they can be relatively easily fastened to each other and detached from each other several times. This results in the switching device assemblies being easily expandable and modifiable. For example, a new additional module could easily be added to the assembly of FIG. 3 between the additional module 5 farthest to the right and the pole cell module 3.

In an embodiment, the modules of the switching device according to the invention are fastened to each other with screws that extent in the axial direction. In a preferred embodiment, the switching device assembly comprises at least one axially extending screw for each module such that said at least one screw is substantially of the length of said module and that its first end, which is designed to enable the driving of said screw with a tool, is provided also with a thread, into which a thread at the other end of a second screw can be driven. It is obvious to a person skilled in the art that the basic idea of the invention can be implemented in a variety of ways. Consequently, the invention and its embodiments are not restricted to the above examples, but may vary within the scope of the claims.

The invention claimed is:

1. A modular switching device comprising a plurality of interconnected modules, said modules comprising a control device module and a pole cell module, said modules of the switching device being interconnected with a shaft adapted to transfer a torque required for operating the switching device from one module to another module, wherein each module comprises a shaft element, and wherein said shaft transferring the torque is composed of directly interconnected shaft elements, both ends of a shaft element of each module being provided with a connecting member for connecting the shaft element to a shaft element of an adjacent module, a connecting member provided at a first end of the shaft element of each module being a male connecting member of a grooved shaft type having a plurality of teeth, and a connecting member provided at a second end is a female connecting member adapted to be connected to a male connecting member of an adjacent module, the shaft element of each module comprising means for connecting the shaft element to a shaft element of an additional module, said means for connecting the shaft element to a shaft element of an additional module comprising at least one universal tooth formed on the male connecting member of the shaft element of each module, and a counterpart member for the at least one universal tooth formed at the female connecting member of the shaft element of each module, the at least one universal tooth having a shape different from the shape of the rest of the plurality of teeth formed on the male connecting member of the shaft element.

2. A modular switching device as claimed in claim 1, wherein each of said modules is an independent module having six walls and being shaped substantially as a rectangular parallelepiped.

3. A modular switching device as claimed in claim 1, wherein the universal tooth of each male connecting member has a length different from the length of the rest of the plurality of teeth formed on said male connecting member.

4. A modular switching device as claimed in claim 1, wherein the universal tooth of each male connecting member has a width different from the width of the rest of the plurality of teeth formed on said male connecting member.

5. A modular switching device as claimed in claim 1, comprising two modules that have frames of different sizes and are directly interconnected via said shaft elements.

6. A modular switching device as claimed in claim 5, wherein one of said two directly interconnected modules having frames of different sizes is an additional module, such as an auxiliary contact module.

7. A switch device module comprising a shaft element adapted to be directly connected to a shaft element of another switch device module for transferring a torque from the switch device module to the another switch device module, both ends of the shaft element of the switch device module being provided with a connecting member for connecting the shaft element to a shaft element of the another module, a connecting member provided at a first end of the shaft element being a male connecting member of a grooved shaft type having a plurality of teeth, and a connecting member provided at a second end is a female connecting member adapted to be connected to a male connecting member of another module, the shaft element comprising at least one universal tooth formed at the male connecting member of the shaft element, and a counterpart member for the at least one universal tooth formed at the female connecting member of the shaft element, the at least one universal tooth having a shape different from the shape of the rest of the plurality of teeth formed on the male connecting member of the shaft element.

8. A switch device module as claimed in claim 7, wherein the switch device module is an independent module having six walls and being shaped substantially as a rectangular parallelepiped.

9. A switch device module as claimed in claim 7, wherein the male connecting member and the female connecting member are shaped as counterparts of each other.

* * * * *